US006339376B1

(12) United States Patent
Okada

(10) Patent No.: US 6,339,376 B1
(45) Date of Patent: Jan. 15, 2002

(54) AUTOMOTIVE CARGO SPACE OCCUPANT DETECTOR

(75) Inventor: Hiroki Okada, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/685,141

(22) Filed: Oct. 11, 2000

(30) Foreign Application Priority Data

Oct. 26, 1999 (JP) ..... 11-304316

(51) Int. Cl.[7] ..... G08B 13/18

(52) U.S. Cl. ..... 340/562; 340/438; 340/530; 340/562; 340/565; 340/425.5; 340/426; 340/573.1

(58) Field of Search ..... 340/562, 438, 340/529, 530, 540, 541, 551, 552, 565, 566, 567, 667, 825.06, 825.17, 5.1, 5.2, 573.1, 425.5, 426, 561

(56) References Cited

U.S. PATENT DOCUMENTS 3,828,335 A * 8/1974 Salmet ..... 340/552
4,215,341 A * 7/1980 Cole ..... 340/552
5,859,479 A * 1/1999 David ..... 307/10.8
6,018,292 A * 1/2000 Penny, Jr. ..... 340/426
6,024,388 A * 2/2000 Tomah et al. ..... 292/216
6,086,131 A * 7/2000 Bingle et al. ..... 296/76
6,091,322 A * 7/2000 Ang et al. ..... 340/425.5
6,130,614 A * 10/2000 Miller et al. ..... 340/573.4
6,135,514 A * 10/2000 Kowalewski et al. ..... 292/216
6,209,933 B1 * 4/2001 Ang et al. ..... 292/336.3
6,222,442 B1 * 4/2001 Gager et al. ..... 340/426

FOREIGN PATENT DOCUMENTS

| | | |
|---|---|---|
| JP | 6-52449 | 2/1994 |
| JP | 7-329722 | 12/1995 |
| JP | 8-258671 | 10/1996 |
| JP | 11-88138 | 3/1999 |

* cited by examiner

*Primary Examiner*—Daniel J. Wu
*Assistant Examiner*—Toan Pham
(74) *Attorney, Agent, or Firm*—Oliff & Berridge, PLC

(57) ABSTRACT

A moving object detecting apparatus, an abnormality alarm apparatus, and a load-carrying compartment opening control apparatus each have an oscillator circuit, an antenna, and a frequency fluctuation detector. If a moving object, such as a human or the like, exists near the antenna when a signal from the oscillator circuit is transmitted from the antenna, the load on the antenna fluctuates due to fluctuations in capacitance involved in the movement of the object. Due to the fluctuations in the antenna load, the oscillating frequency of the oscillator circuit fluctuates. The frequency fluctuations are detected by the frequency fluctuation detector.

19 Claims, 14 Drawing Sheets

AUTOMOTIVE CARGO SPACE OCCUPANT DETECTOR

INCORPORATION BY REFERENCE

The disclosure of Japanese Patent Application No. 11-304316 filed on Oct. 26, 1999 including the specification, drawings and abstract is incorporated herein by reference in its entirety.

BACKGROUND OF THE INVENTION

1. Field of the Invention

The invention relates to a moving object detecting apparatus, an abnormality alarm apparatus, and a load-carrying compartment opening control apparatus.

2. Description of Related Art

Many vehicles have, in addition to a passenger compartment, a trunk compartment (load-carrying compartment) isolated from the passenger compartment. The trunk compartment is provided for placing various kinds of baggage. Although it is recommended that a driver check the inside of the trunk compartment, it is an object of the invention to provide some detection or alarm for telling a driver in case of, for example, an accident where a child or a pet is locked inside the trunk compartment while playing.

Various vehicular theft deterrent apparatus have been proposed. For example, Japanese Patent Application Laid-Open No. 6-52449 discloses an apparatus that continually transmits and receives ultrasonic waves using an ultrasonic transmitter-receiver, and detects an invader based on the Doppler effect in the reflected waves from the invader. Various apparatus also exist with regard to systems that detect an invader based on detection of an interruption of an infrared ray.

If an apparatus as described above is installed in a trunk compartment, it becomes possible to detect a child, a pet, etc., confined in the trunk compartment.

However, the apparatus using the Doppler effect have problems of a complicated system construction and a high cost. Furthermore, a plurality of objects cannot be detected unless Doppler effects are detected after reflected waves from the objects are separated in accordance with the distances of the objects. However, it is difficult to distinguish a plurality of objects and detect a movement of one of the objects.

The apparatus using infrared rays also have the following problem. That is, if a piece of baggage or the like is placed near an infrared light emitter portion, no other object can be detected at all.

SUMMARY OF THE INVENTION

Accordingly, it is an object of the invention to provide a moving object detecting apparatus, an abnormality alarm apparatus, and a load-carrying compartment opening control apparatus each capable of reliably detecting a moving object while employing a simple apparatus construction.

A moving object detecting apparatus in accordance with one aspect of the invention includes an oscillator circuit that is connected to at least one electrically conductive member and that changes an oscillating frequency based on a change in capacitance of a space near the at least one electrically conductive member, and a frequency change detection circuit that detects a change in the oscillating frequency of the oscillator circuit. Based on a result of detection by the frequency detection circuit, a moving object present in the space near the at least one electrically conductive member can be detected.

If a moving object, such as a human, a pet, etc., exists near an electrically conductive member, the capacitance of the space adjacent to the electrically conductive member changes, and the oscillating frequency of the oscillator circuit fluctuates in accordance with movements of the object. Therefore, by detecting fluctuations in the oscillating frequency, a moving object can be detected.

An abnormality alarm apparatus in accordance with another aspect of the invention has an alarm device that produces an alarm based on a result of detection by the frequency change detection circuit. For example, the alarm device indicates to a driver that a moving object is detected in the trunk, so that the driver can take a proper action in response to the alarm indication. The alarm may be provided in various forms, such as a sound, a display, etc.

In a load-carrying compartment opening control apparatus in accordance with another aspect of the invention, the at least one electrically conductive member of the moving object detecting apparatus is provided in a load-carrying compartment isolated from a passenger compartment of a vehicle. The load-carrying compartment opening control apparatus has an opener that opens an open-close member of the load-carrying compartment when the frequency change detection circuit detects a moving object during a stop of the vehicle. Therefore, if a human, a pet or the like is unintentionally confined in a trunk, the load-carrying compartment opening control apparatus is able to automatically open the load-carrying compartment.

The frequency change detection circuit may include a receiver that is disposed apart from the antenna and that receives an electromagnetic wave transmitted from the antenna. A change in the frequency of the electromagnetic wave received by the receiver can be detected. Therefore, frequency fluctuations can be detected by the receiver disposed apart from the antenna. Therefore, it is possible for the system of the invention to use the reception equipment of a different system, for example, a smart entry system or the like.

BRIEF DESCRIPTION OF THE DRAWINGS

Preferred embodiments of the invention will be described with reference to the accompanying drawings, wherein like numerals are used to represent like elements and wherein.

DETAILED DESCRIPTION OF PREFERRED EMBODIMENT(S)

Figure 1:
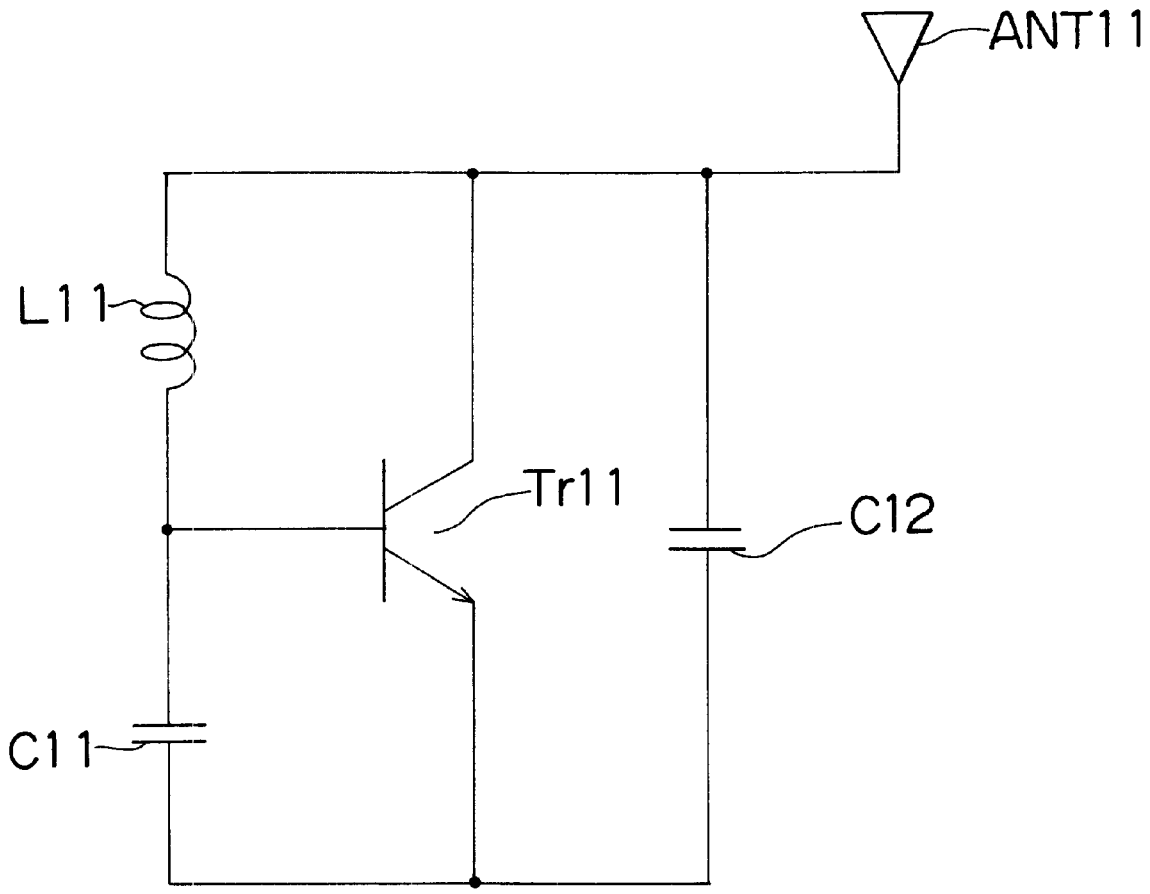
FIG. 1 is a diagram illustrating a construction of a Colpitts oscillator circuit.

FIG. 1 illustrates a construction of a Colpitts oscillator circuit that forms a basic construction of an oscillator circuit in the invention. As shown in FIG. 1, the collector of a transistor Tr11 is connected to an antenna ANT11. A coil L11 is connected between the collector and the base of the transistor Tr11. A capacitor C11 is connected between the base and the emitter of the transistor Tr11. Furthermore, a capacitor C12 is connected between the collector and the emitter of the transistor Tr11.

The thus-constructed Colpitts oscillator circuit resonates at a resonance frequency that is determined in accordance with the capacitance of the capacitors C11, C12 and the inductance of the coil L11. As for the Colpitts oscillator circuit, the oscillating frequency changes depending on conditions around the antenna ANT11. For example, if an electrical conductor exists near the antenna ANT11 or if a large-size object having a permittivity different from that of the air exists near the antenna ANT11, the impedance (capacitance) viewed from the antenna ANT11 becomes different, so that the oscillating frequency changes.

Figure 2:
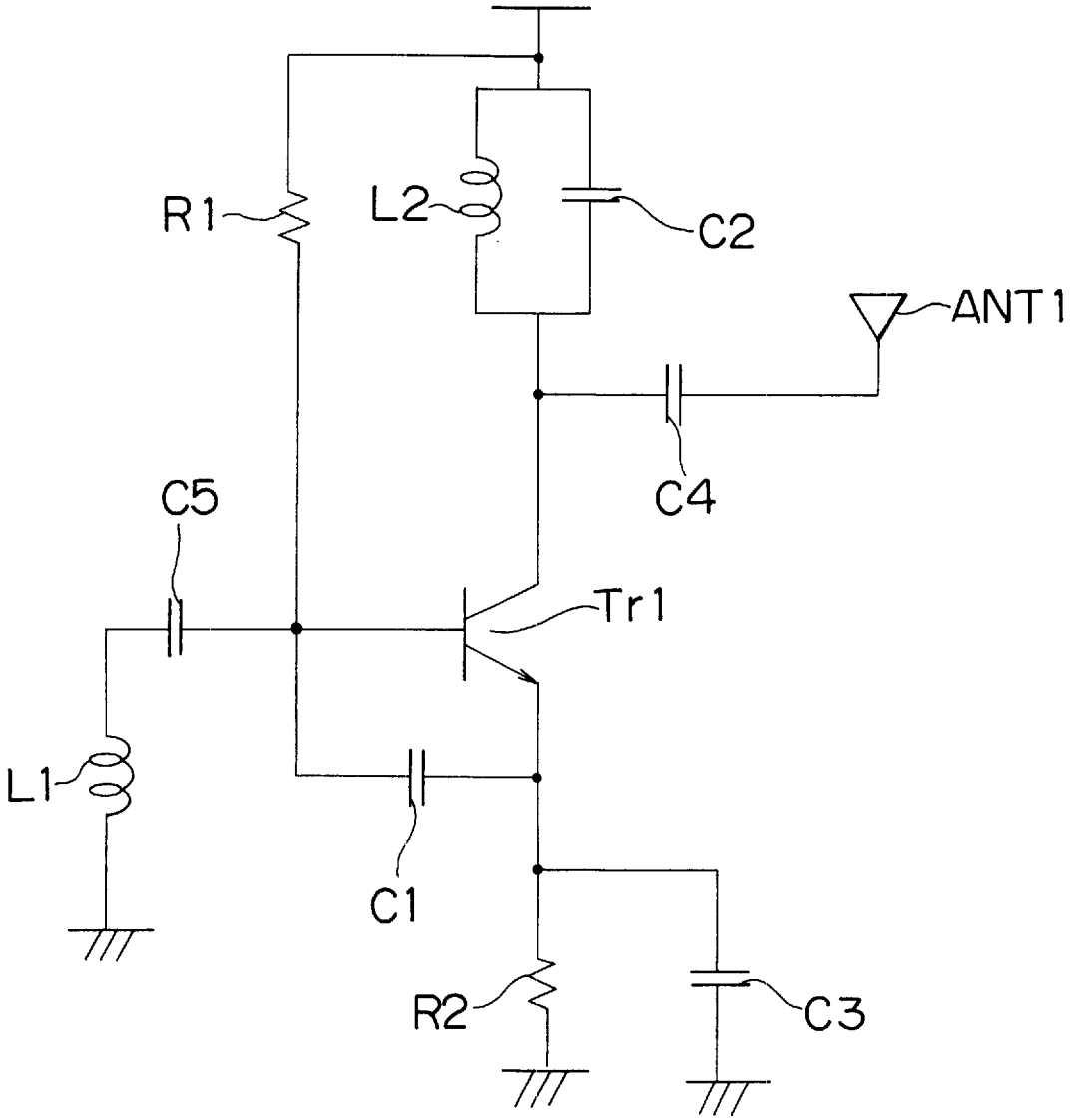
FIG. 2 is a diagram illustrating a construction of an oscillator circuit whose frequency fluctuates.

FIG. 2 illustrates a specific oscillator circuit having a construction based on a Colpitts oscillator circuit as shown in FIG. 1. In the circuit shown in FIG. 2, the collector of a transistor Tr1 is connected to an antenna ANT1 via a capacitor C4. The collector of the transistor Tr1 is connected to a power supply via a capacitive tank circuit formed by a coil L2 and a capacitor C2 connected in parallel. The base of the transistor Tr1 is connected to the power supply via a resistor R1. The base of the transistor Tr1 is grounded via a capacitor C5 and a coil L1. The base and the emitter of the transistor Tr1 are interconnected via a capacitor C1. The emitter of the transistor Tr1 is grounded via a capacitor C3 and a resistor R2.

This circuit oscillates if the capacitors C3, C5 are capacitors (pass capacitors) that are low in impedance level so as not to affect the oscillating frequency and if the tank circuit formed by the coil L2 and the capacitor C2 is a capacitive tank circuit. The oscillating frequency of the oscillator circuit is basically determined by the components L1, C1, L2, C2, and is affected by the value of the capacitor C4 and the load of the antenna ANT1. In an ordinary oscillator circuit, the effect of the antenna ANT1 on the oscillating frequency is curbed by reducing the capacitance of the capacitor C4. In this embodiment, however, the capacitance of the capacitor C4 is increased so that the antenna ANT1 couples to the oscillator circuit in an alternating current fashion.

Various kinds of objects can exist near the antenna ANTI of the above-described circuit. If an object exists near the antenna ANTI, the load on the electromagnetic waves radiated from the antenna ANT1 changes, so that the frequency of the oscillator circuit changes. Basically, the presence of an object near the antenna ANT1 changes the capacitance viewed from the antenna ANT1, so that the oscillating frequency changes. In particular, when the object moves, the oscillating frequency fluctuates.

Figure 3A:
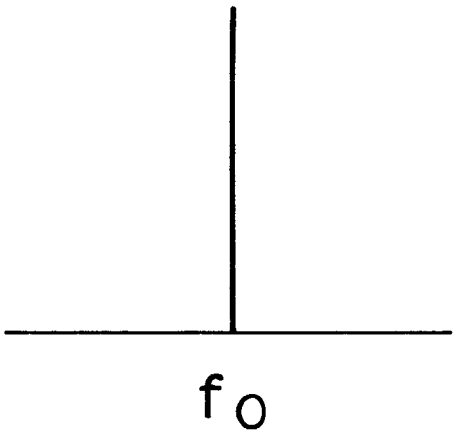
FIGS. 3A, 3B and 3C are diagrams illustrating frequency fluctuations.

FIG. 3A indicates the spectrum of the oscillating frequency in a case where no object that affects the antenna ANT1 exists near the antenna ANT1, that is, where there is no particular load and no load fluctuation. As indicated, the circuit oscillates at a stable frequency $f_0$ that is determined based on the values of the various elements.

Figure 3B:
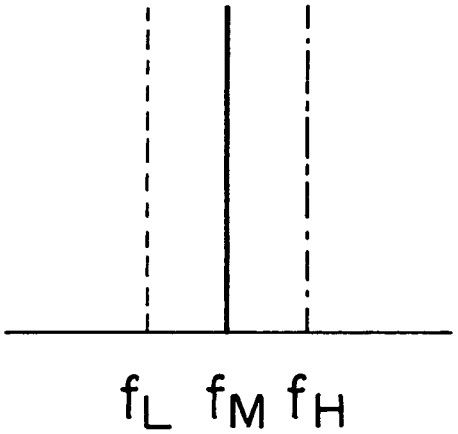

FIG. 3B indicates the spectrum of the oscillating frequency when a moving object (e.g., a human) that affects the antenna ANT1 exists near the antenna, that is, where there is a load fluctuation. In this case, the frequency changes as indicated by a solid line, a broken line, and a one-dot chain line due to the load fluctuation. If the moving object continues moving, the oscillating frequency moves back and forth, for example, between $f_L$, $f_M$, and $f_H$. As a result, the frequency fluctuates as if it is frequency-modulated.

Figure 3C:
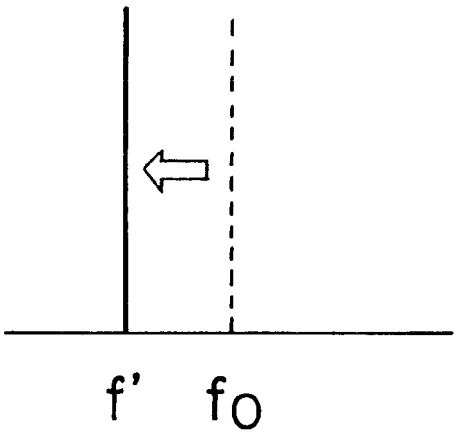

FIG. 3C indicates an oscillating frequency spectrum when an object that affects the antenna ANT1 exists near the antenna ANT1 but the object does not move. If the oscillating frequency with no object existing near the antenna ANT1 is $f_0$, the presence of the object changes the oscillating frequency to f'. However, since the object does not move, the oscillating frequency becomes stable at f'. Therefore, if a piece of baggage or the like that affects the antenna ANT1 is placed in the trunk compartment, the oscillating frequency does not fluctuate since baggage or the like do not move without an external force.

Thus, the presence of a moving object can be detected based on whether there is a fluctuation in the oscillating frequency.

Therefore, if the antenna ANT1 is disposed in a trunk compartment, it becomes possible to detect a moving object within the trunk compartment. It is preferable that the determination as to whether the oscillating frequency fluctuates be conducted during a stop of the vehicle (at a vehicle speed of 0) since during running, a piece of baggage or the like may be moved.

As for the antenna ANT1, a loop antenna (magnetic field detection type), a pattern antenna formed on a printed circuit board, etc., are preferable because they allow cost reductions.

Figure 4B:
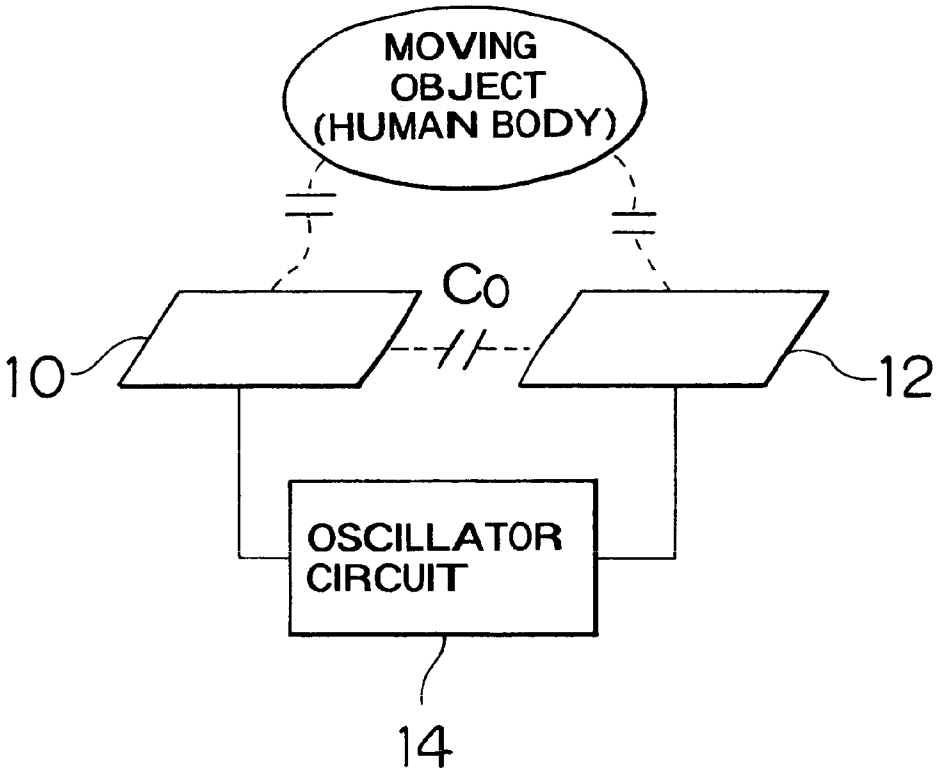
FIGS. 4A and 4B are diagrams illustrating a construction of an oscillator circuit for detecting fluctuations in the oscillating frequency with an adjacent space functioning as a capacitor.
Figure 4A:
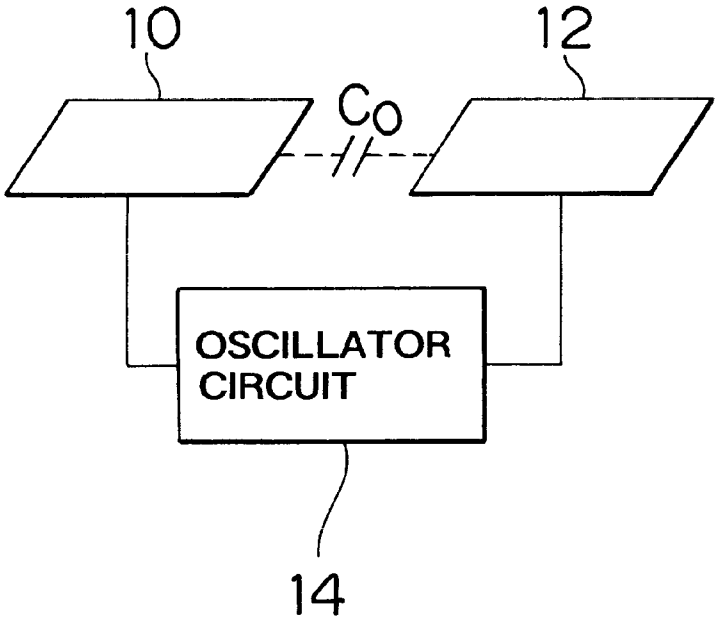

As indicated in FIG. 4A, a pair of electrically conductive plates 10, 12 are connected to an oscillator circuit 14. In this manner, a space of interest between the conductive plates 10, 12 in which the detection of an object is desired can be incorporated into the oscillator circuit in the form of a large-size capacitor. If a human body or the like moves within the space, the capacitance changes, so that the oscillating frequency correspondingly changes. Therefore, by detecting a fluctuation in the oscillating frequency of the oscillator circuit 14, a moving object can be detected.

As the oscillator circuit 14, the circuit shown in FIG. 1 or 2 may be used. In that case, one of the conductive plates 10, 12 is used as the antenna ANT1 or ANT11, and the other conductive plate is grounded.

As a result, an oscillating frequency is determined based on a capacitance $C_0$ as indicated in FIG. 4A, where no object exists in the space of interest. If a moving object (human body) exists in the space, in which the detection is desired, as indicated in FIG. 4B, the capacitance of a capacitor formed by the conductive plates 10, 12 and the space of detection changes. When the human body moves, the capacitance of the capacitor fluctuates, so that the oscillating frequency fluctuates. Therefore, by detecting a fluctuation in the oscillating frequency, the presence of a moving object within the space of interest can be detected.

Figure 5:
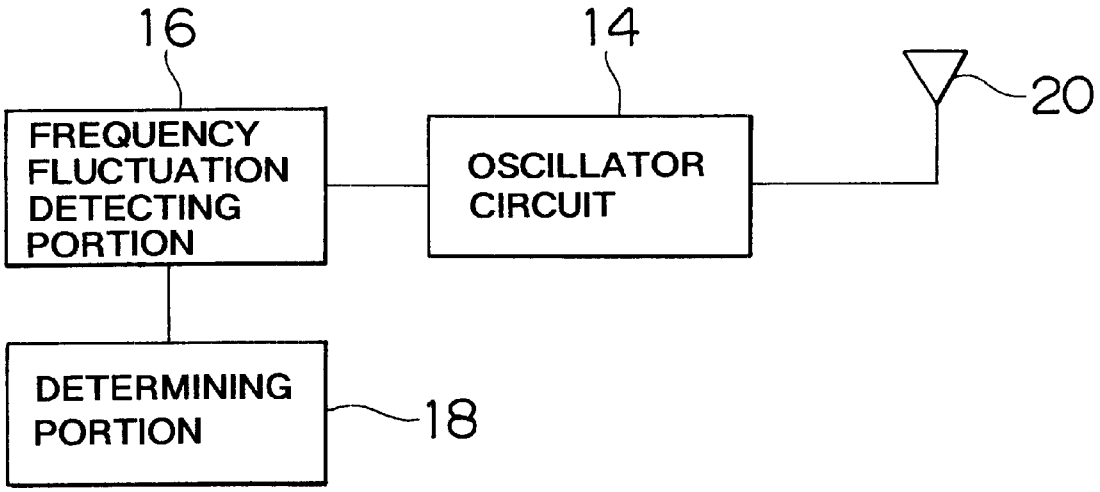
FIG. 5 is a diagram illustrating a construction for detecting frequency fluctuations.

In this embodiment, a fluctuation in the oscillating frequency of the oscillator circuit 14 is detected. To that end, a frequency fluctuation detecting portion 16 is connected to the oscillator circuit 14 as shown in FIG. 5, and it is detected by the frequency fluctuation detecting portion 16 whether there is a fluctuation in the oscillating frequency of the oscillator circuit 14. The result of detection is supplied to a determining portion 18 that determines whether there is a moving object based on whether there is a frequency fluctuation.

In FIG. 5, an antenna 20 is connected to the oscillator circuit 14. The antenna 20 corresponds to the antenna ANT11 in FIG. 1, the antenna ANT1 in FIG. 2, and the conductive plates 10, 12 in FIG. 4.

Furthermore, the frequency fluctuation detecting portion 16 is preferably formed by a frequency-voltage converting circuit. A preferable frequency-voltage converting circuit is, for example, a quadrature detector circuit shown in FIG. 6.

Figure 6:
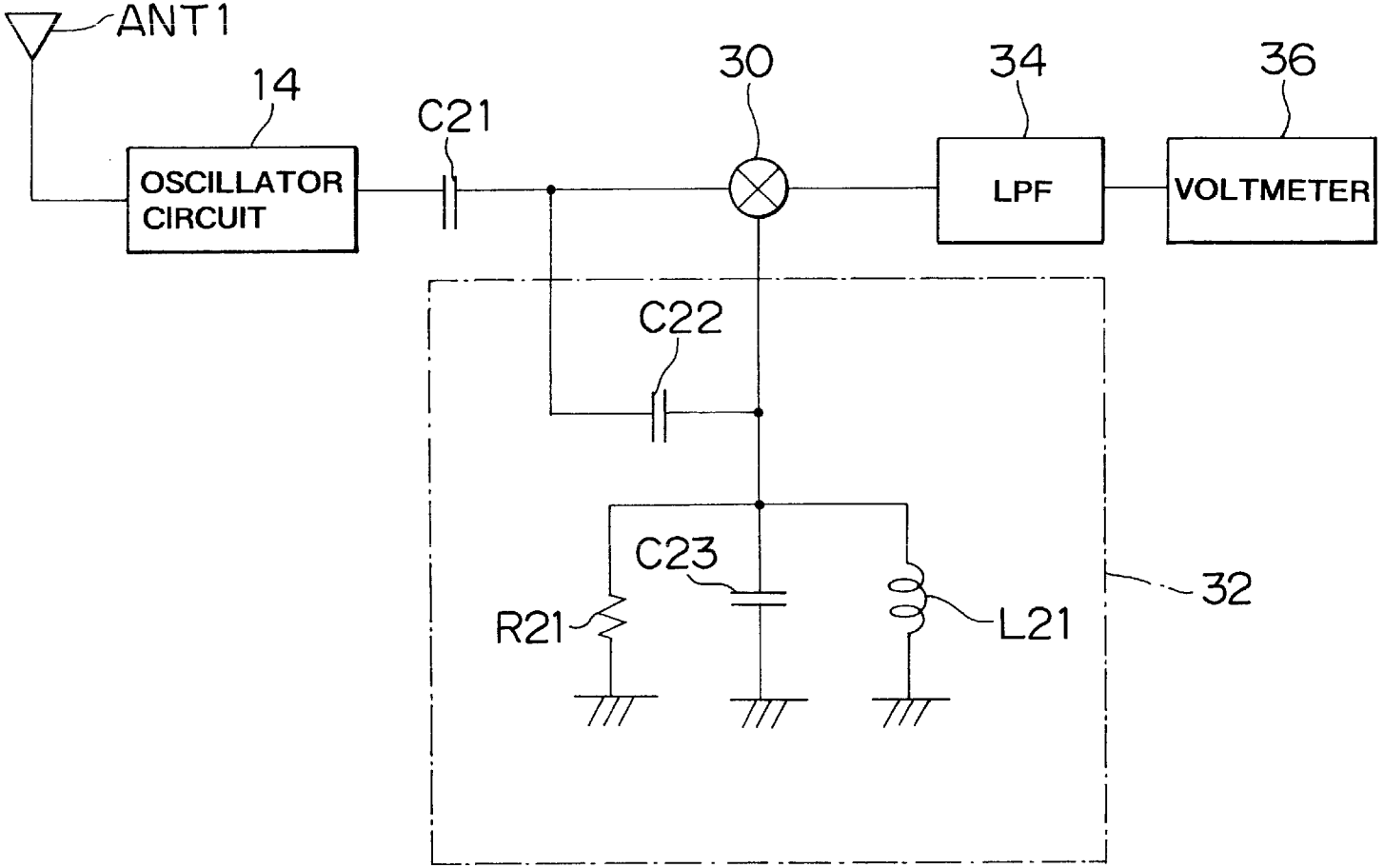
FIG. 6 is a diagram exemplifying a frequency-voltage converting circuit.

The frequency fluctuation detecting portion 16 shown in FIG. 6 is equipped with the oscillator circuit 14. The oscillator circuit 14 is connected to a multiplier 30 via a capacitor C21 for cutting direct currents. The multiplier 30 is also supplied with an output from the capacitor C21 via a $\pi/2$-phase shifter 32. Therefore, the multiplier 30 multiplies two outputs from the oscillator circuit 14 that are shifted $\pi/2$ in phase from each other.

The $\pi/2$-phase shifter 32 has a capacitor 22, a resistor R21, a capacitor C23, and a coil L21. The capacitor 22 is connected at one end thereof to a connecting portion between the capacitor C21 and one input end of the multiplier 30. The other end of the capacitor 22 is connected to another input end of the multiplier 30. Another end side of the multiplier 30 is connected to the resistor R21, the capacitor C23, and the coil L2. The end side of the multiplier 30 is grounded via the resistor R21.

Figure 7:
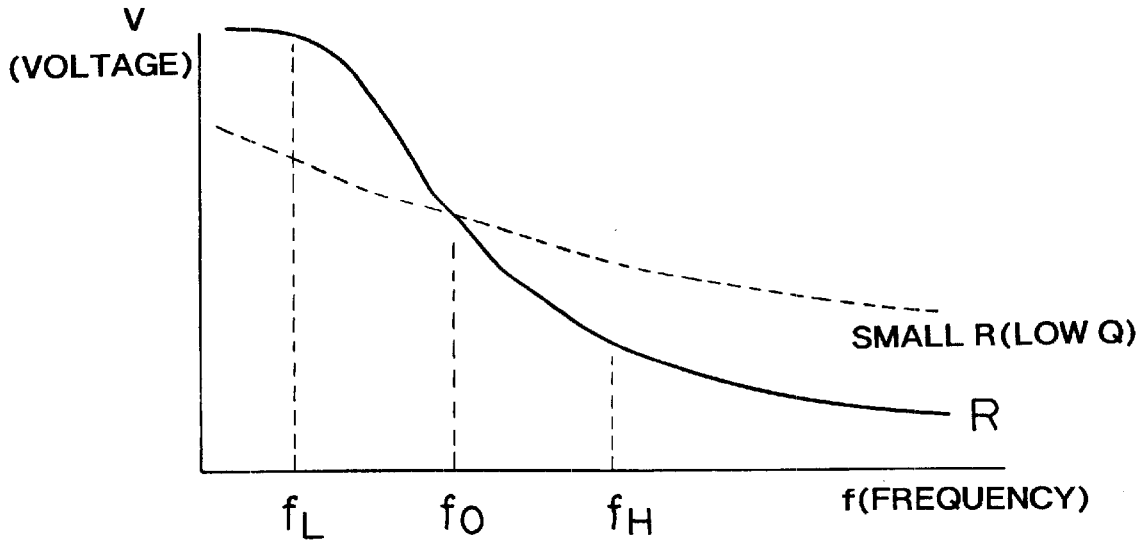
FIG. 7 is a graph indicating frequency-voltage conversion.

The output of the multiplier 30 is connected to a voltmeter 36 via a low-pass filter (LPF) 34. As the output of the voltmeter 36, voltage that increases with decreases in the oscillating frequency of the oscillator circuit 14 as indicated in FIG. 7 is provided. Therefore, by detecting a fluctuation in the value of output voltage of the voltmeter, the presence of a moving object can be detected. As indicated by a broken line in FIG. 7, if the resistance of the resistor R21 is reduced, a relatively flat conversion characteristic is obtained although the sensitivity to fluctuations in the frequency decreases (Q decreases). Therefore, it is preferable to achieve an appropriate characteristic by adjusting the resistor R21.

Thus, the circuit shown in FIG. 6 is able to detect a change in the oscillating frequency of the oscillator circuit 14 while employing a simple circuit construction. Therefore, the cost of the entire circuit can be reduced.

If a phase-locked loop (PLL) circuit is used as a frequency-voltage converting circuit, a frequency change can be detected with a higher precision.

In the above-described embodiment, the frequency fluctuation detecting portion 16 is directly connected to the oscillator circuit 14 as shown in FIG. 5, and the output of the oscillator circuit 14 is directly supplied to the frequency fluctuation detecting portion 16. However, it is also preferable that electromagnetic waves radiated from the antenna 20 be received, and a fluctuation in the frequency of the received electromagnetic waves be detected for the aforementioned determination.

Figure 8:
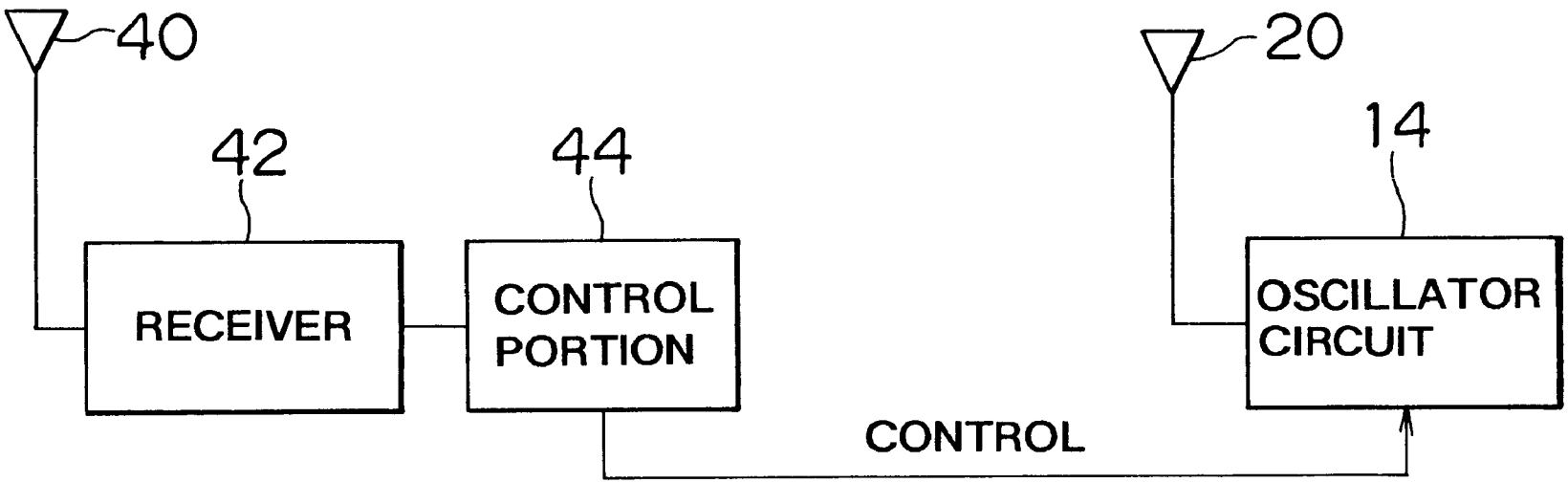
FIG. 8 is a diagram illustrating a construction in which a receiver is disposed apart.

That is, as shown in FIG. 8, an antenna 40 for receiving electromagnetic waves transmitted from the antenna 20 is provided apart from the antenna 20. For example, the antenna 20 is provided in a trunk compartment of a vehicle, and the antenna 40 is provided in the passenger compartment. The antenna 40 is connected to a receiver 42, in which the reception processing of the electromagnetic waves received by the antenna 40 is performed. The receiver 42 is connected to a control portion 44. The control portion 44 detects a fluctuation in the frequency of the received signal, and determines whether there is a moving object.

This construction makes it possible to share the antenna 40, the receiver 42, and the control portion 44 with an apparatus that performs a different function. For example, in a smart entry system, a communication is conducted between a portable device carried by a driver and a vehicle-side device. When the vehicle-side device recognizes that the present communication is a communication with a pre-registered portable device, the system performs a control such as cancellation of an immobilizer or the like. If such a system is installed in a vehicle, a device for the above-described communication is disposed in the passenger compartment (e.g., near a front panel). This device may be used as a combination of the antenna 40, the receiver 42 and the control portion 44 shown in FIG. 8.

In the above-described apparatus, the control portion 44 sends a control signal to the oscillator circuit 14, and controls the operation of the oscillator circuit 14. That is, the control portion 44 controls the timing of oscillation of the oscillator circuit 14, and performs the reception processing synchronously with the oscillation timing. Therefore, the control portion 44 is able to recognize that the received electromagnetic waves are transmitted from the antenna 20, so that stable processing can be performed.

Figure 9:
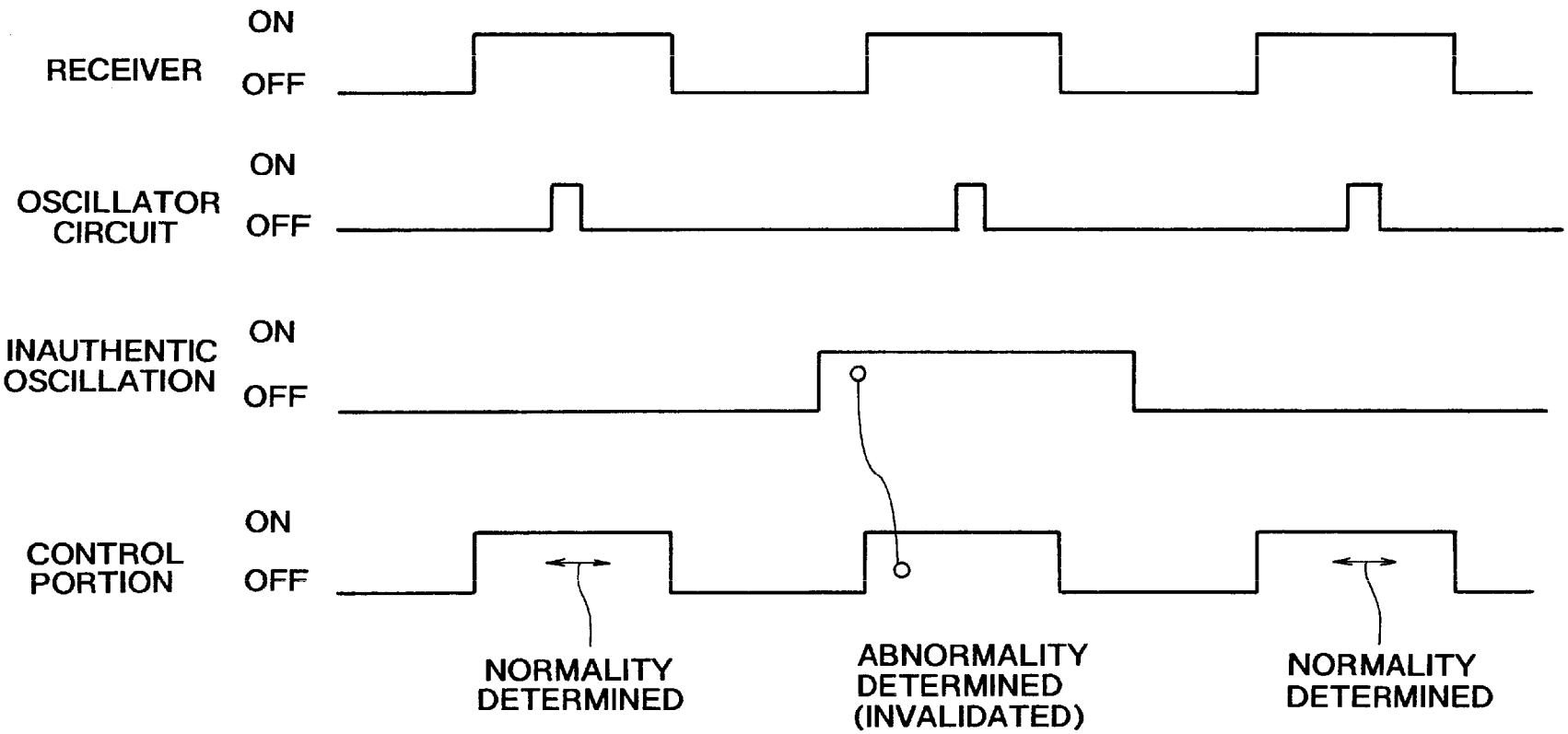
FIG. 9 is a diagram illustrating operations of a construction wherein the oscillator circuit and the receiver are synchronized.

For example, as indicated in FIG. 9, the receiver 42 is periodically turned on for a predetermined time, and during the on-period, electromagnetic waves are transmitted from the antenna 20. The control portion 44 performs a process of detecting a frequency fluctuation only during the period when the electromagnetic waves are transmitted from the antenna 20. If any electromagnetic wave is received outside the period, the control portion 44 invalidates the received electromagnetic wave. For example, if the control portion 44 turns on and receives electromagnetic waves when the antenna 20 is not transmitting electromagnetic waves, the control portion 44 determines that the received electromagnetic waves are from an unauthorized oscillation source, and invalidates the electromagnetic waves.

Thus, if an oscillation from the antenna 20 is performed synchronously with the frequency fluctuation detecting process, reception of an inauthentic oscillation can be recognized and invalidated. Therefore, even if an inauthentic oscillation is similar in frequency and frequency fluctuation to a signal of detection of a movement of a human body, the inauthentic oscillation can be invalidated.

As indicated above, it is preferable that the electromagnetic waves used for the communications in the passenger compartment by the smart entry system and the electromagnetic waves used for transmission from the antenna 20 be in the same frequency band (e.g., a 300-MHz band). If the apparatus of the embodiment and the smart entry system share the aforementioned device, it is advisable to perform the detection of a movement of a human body at a timing when the communication of the smart entry system is not performed (time sharing).

The occasion of confinement in the trunk compartment or the like is predictable to some extent. Therefore, the rate of performing the detection of a moving object may be increased, for example, immediately after the trunk lid is closed. It is also possible to combine the above-described detection means with other detection means, for example, a microphone or the like, and to perform the detection of a moving object when an abnormal noise is detected.

Furthermore, it is preferable to superimpose a code on the oscillating frequency in the oscillator circuit 14. For example, if vehicles equipped with similar systems exist adjacent to each other, it may be conceivable based on the nature of electromagnetic waves that electromagnetic waves from the adjacent vehicle are received. Owing to the aforementioned synchronization within each system, the probability of coincidence in timing between two systems is considered to be low. However, there is a possibility of such timing coincidence. If such coincidence occurs, normal detection cannot be performed.

Therefore, a serial number specific to each vehicle is superimposed as a code on the electromagnetic waves to be transmitted from the antenna 20. As a result, the electromagnetic waves transmitted from the oscillator circuit 14 are modulated with the code. Thus, since the signal from the oscillator circuit 14 is modulated with the code (the serial number of the vehicle in which the detecting apparatus is installed), it becomes possible to determine whether a received signal is a signal transmitted within the vehicle in which the detecting apparatus is installed.

Figure 10:
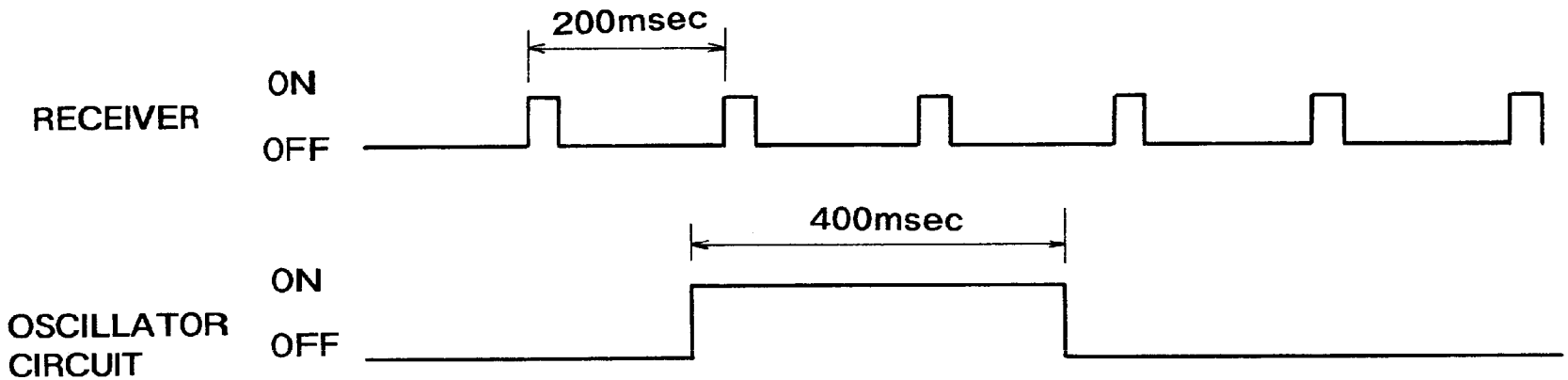
FIG. 10 is a diagram illustrating operations of an asynchronous construction.

With this construction, the detecting apparatus can extract only the information regarding itself, so that it becomes unnecessary to synchronize the transmission of electromagnetic waves from the oscillator circuit 14. For example, as indicated in FIG. 10, the receiver 42 is activated for reception every 200 msec, and the oscillator circuit 14 is activated every 60 seconds to transmit electromagnetic waves for about 400 msec. Thus, although the transmission and the reception are asynchronous, the receiver 42 is able to receive electromagnetic waves from the oscillator circuit 14 without fail. Since the electromagnetic waves from the oscillator circuit 14 are coded, the electromagnetic waves are not affected by interference with other electromagnetic waves, so that highly reliable detection can be performed.

If the oscillator circuit transmits coded electromagnetic waves, it is preferable that the bit rate of the code be different from the frequency changes caused by moving objects such as a human body and the like.

That is, if a frequency fluctuation caused by an object moving near the oscillator circuit 14 is similar to the change in the frequency of the oscillator circuit 14 caused by modulation with the code, the reception of the frequency fluctuation is substantially no different from the reception of electromagnetic waves modulated with a different code. Thus, the detection becomes impossible.

Figure 11A:
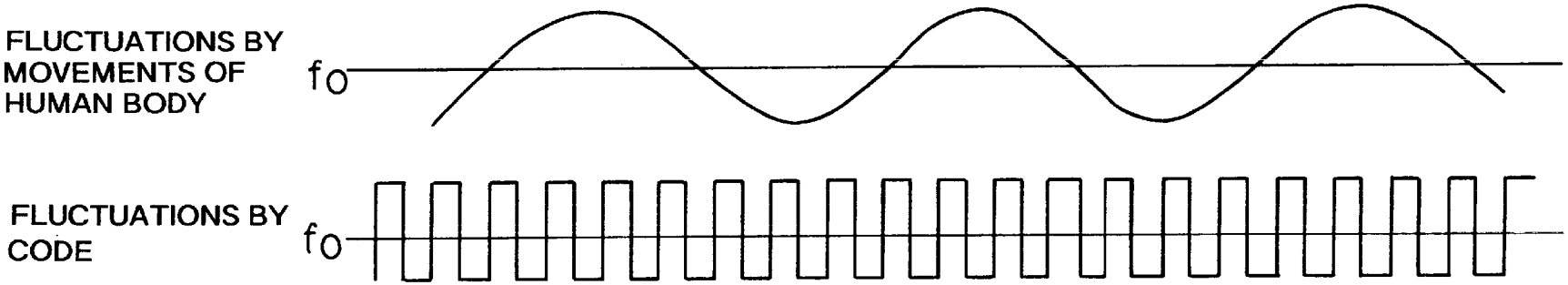
FIGS. 11 A and 11B are diagrams illustrating a construction in which a code is superimposed on electromagnetic waves.

Therefore, it is preferable that the bit rate of the code be sufficiently greater than the frequency of frequency fluctuations caused by movements of a human body, as exemplified in FIG. 11A. As a result, frequency fluctuations caused by movements of a human body can be obtained after the code is removed. Since the movements of a human body include considerably low-speed movements, it is preferable that the bit rate of the code be sufficiently increased so as to differ from the frequency fluctuations caused by movements of a human body.

Figure 11B:
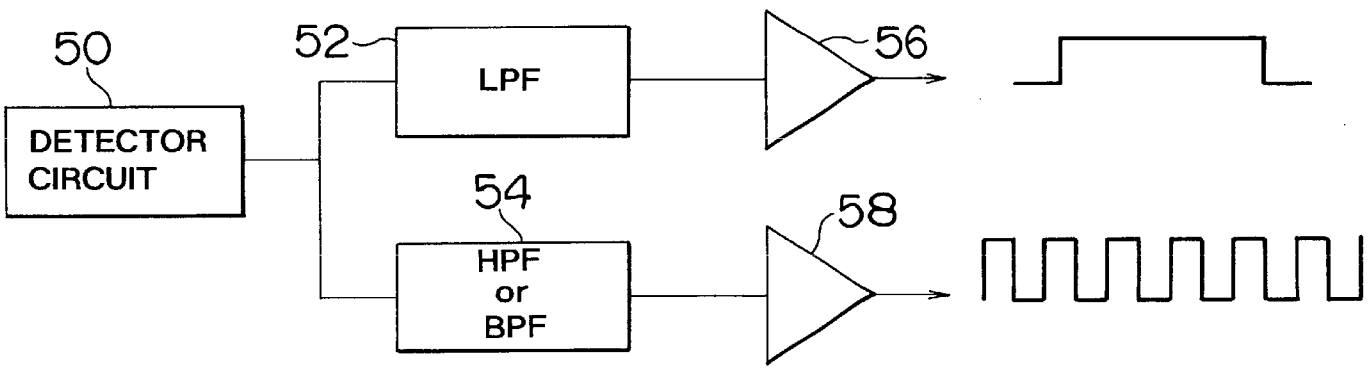

In this case, as shown in FIG. 11B, after detection (frequency-voltage conversion (f-V conversion)) is performed in a detector circuit 50 within the receiver 42, a signal of the detection is supplied to both a low-pass filter 52 and a high-pass filter (or band-pass filter) 54. Thus, the low-pass filter 52 provides a low-frequency signal, and the high-pass filter 54 provides a high-frequency signal. The outputs from the low-pass filter 52 and the high-pass filter 54 are supplied to comparators 56, 58, respectively, and are thereby binarized. Therefore, two kinds of modulation signals of different frequencies, that is, the code and movements of a human body, can be separated. Thus, the sets of information regarding the code and movements of a human body can be correctly recognized.

Although the code is simply superimposed on the electromagnetic waves from the oscillator circuit 14 in the above description, it is also possible to generate a PN code based on the aforementioned code, and to perform spectrum diffusion using the PN code. Therefore, if reverse diffusion is performed at the receiver 42, electromagnetic waves regarding the vehicle in which the detecting apparatus is installed can be obtained.

Furthermore, the foregoing embodiment employs an LC oscillator circuit as shown in FIG. 2, as the oscillator circuit 14. However, the oscillator circuit 14 may be a different type of circuit. For example, various resonating elements may be used in the oscillator circuit, so that the precision of the oscillating frequency can be improved.

As the resonating elements, it is conceivable to use a ceramic oscillator, a quartz oscillator, a SAW resonator, a dielectric resonator, a pattern on a printed circuit board, etc. In general, as the resonator value Q is increased, the frequency stability increases and the frequency fluctuation width decreases. However, the frequency fluctuation width with respect to load fluctuation can be adjusted by decreasing the value Q through the use of a resistor, adding an extension coil, etc.

Figure 12:
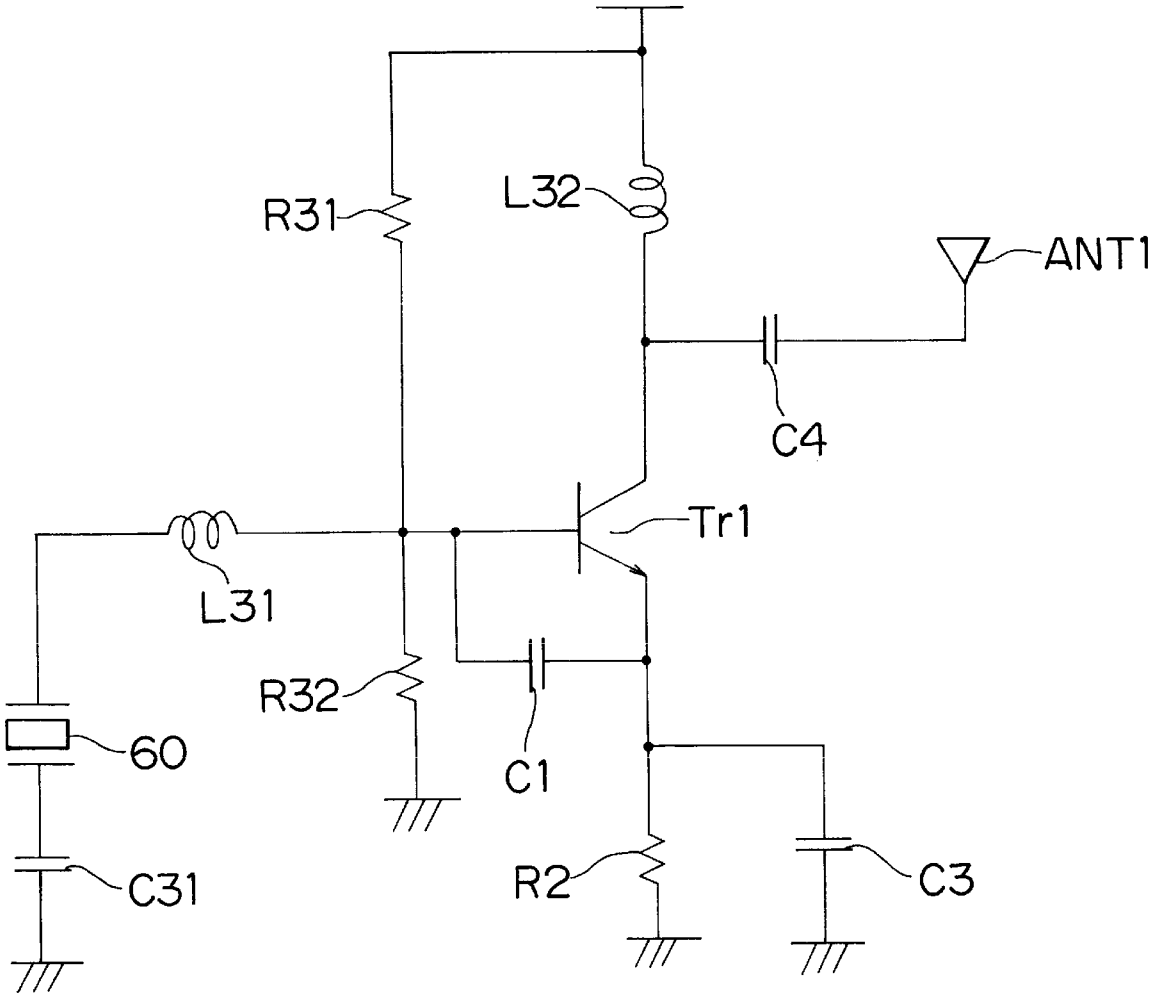
FIG. 12 is a diagram illustrating a construction that employs a SAW resonator.

FIG. 12 exemplifies an oscillator circuit employing a SAW resonator. A SAW resonator 60 is connected to the base of a transistor Tr1 via a coil L31. The collector of the transistor Tr1 is connected to a power supply via a coil L32. The base of the transistor Tr1 is connected to the power supply via a resistor R31, and is connected to a ground via a resistor R32. The base and the emitter of the transistor Tr1 are interconnected via a capacitor C1. The emitter of the transistor Tr1 is grounded via a capacitor C3 and a resistor R2. An antenna ANT1 is connected to the collector of the transistor Tr1 via a capacitor C4. The other end of the SAW resonator 60 is grounded via a capacitor C31.

In this circuit, the oscillating frequency is substantially determined by the value of the SAW resonator 60. Since the precision of the oscillating frequency of the SAW resonator 60 is far better than that of the LC arrangement, this circuit greatly facilitates the adjustment of the oscillating frequency and the like, and is able to make an adjustment-free circuit.

Figure 13:
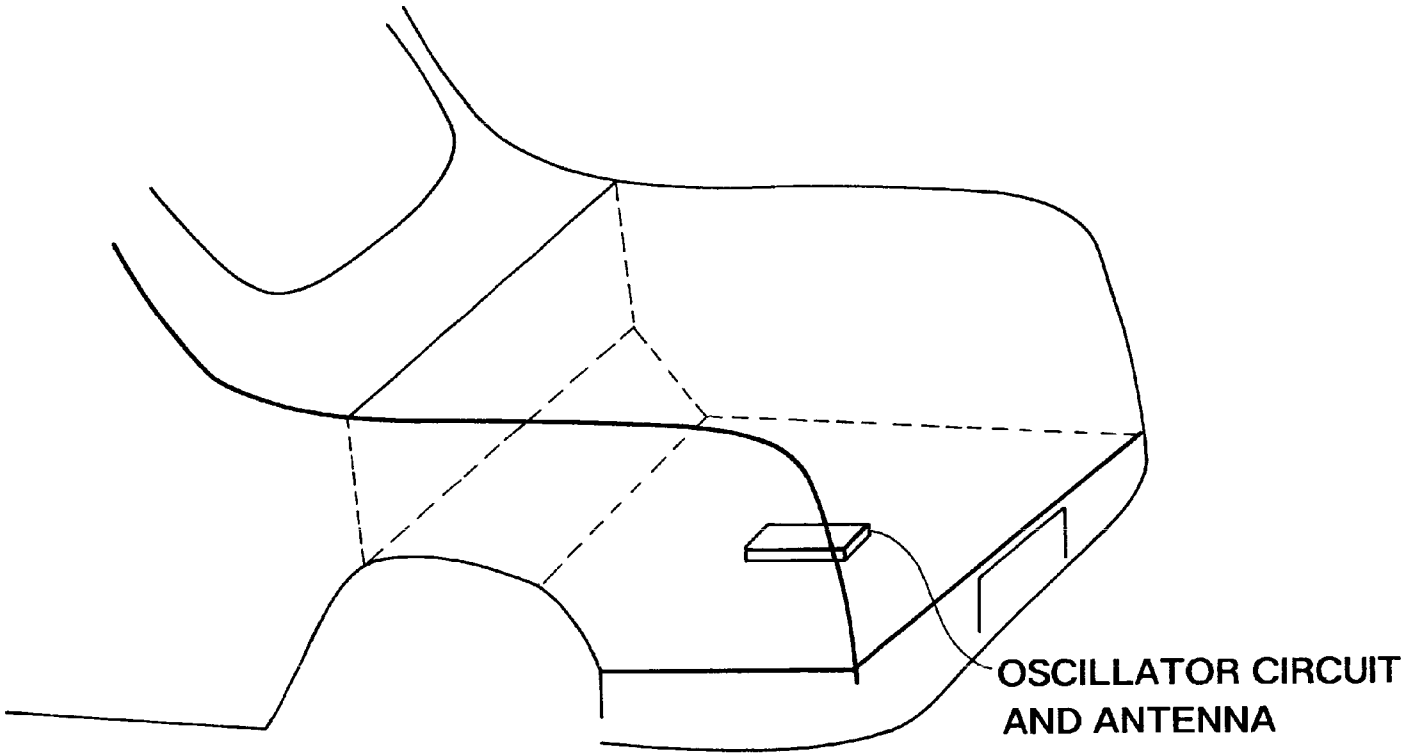
FIG. 13 is a diagram illustrating a case where an oscillator circuit is disposed in a load-carrying compartment.

The above-described moving object detecting apparatus is suitably applicable to a trunk emergency cancellation system. For example, it is preferable to dispose an oscillator circuit and an antenna in a lower central portion of a trunk compartment as shown in FIG. 13. The oscillator circuit and the antenna may be disposed at any location. However, it is preferable to dispose the oscillator circuit and the antenna at lower central locations in the trunk where external influences are less, for the following two reasons: (i) substantially consistent detection over the entire trunk space is possible; (ii) malfunction due to an external influence is unlikely.

Upon recognizing the presence of a moving object in the trunk based on fluctuations in the oscillating frequency during a stop of the vehicle, the system opens the trunk regardless of the use of a key or, instead of opening the trunk, produces an alarm to indicate the possibility of confinement in the trunk to a person outside.

Therefore, should a child or the like enter a trunk and be confined therein, the confinement can be easily detected. If a piece of baggage is placed in the trunk and, due to the effect of the load on the oscillator circuit, the frequency changes, the frequency change is a mere deviation from one frequency to another, and can be distinguished from frequency fluctuations in response to movements of a moving object.

If a detector using an infrared beam or the like is employed, the system becomes inoperable when a piece of baggage or the like covers the light-emitting portion or the light-receiving portion. However, electromagnetic waves propagate around such a blocking object, and therefore allow detection even in such a situation.

Figure 14:
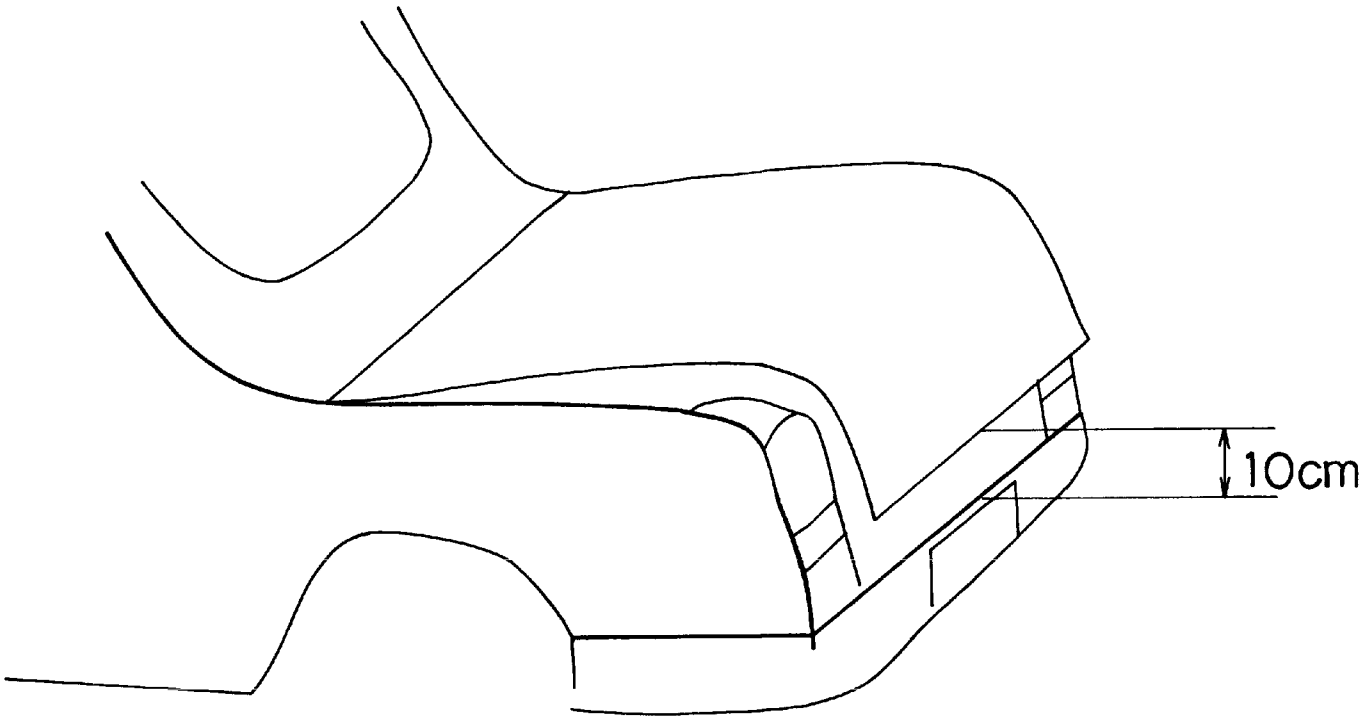
FIG. 14 is a diagram illustrating the opening of the load-carrying compartment to a limited extent.

As the opening of the trunk, it is also preferable to open the trunk in a manner different from the normal manner of opening the trunk, that is, open (half-open) the trunk to a limited extent of, for example, about 10 cm, as shown in FIG. 14.

Confinement in a trunk can happen in various situations, for example, a situation where a child mischievously enters the trunk and is confined, a situation where a pet enters the trunk when it is open, and a person closes the trunk lid without knowing that the pet is inside the trunk, etc. If the trunk lid remains completely closed in such a situation, the temperature in the trunk may become high under a hot sun, or sound or voice passage may be impeded. If the trunk lid is fully open upon detection of a moving object in the trunk, there may arise problems of easiness to steal from the trunk, rain falling into the trunk when raining, etc.

These problems can be resolved by opening the trunk to about 10 cm through operation of the trunk emergency cancellation system.

The system requires an authorized key in order to normally open the trunk. This construction makes a system that is capable of performing required operations at the time of an emergency and is immune to theft or the like.

Furthermore, it is preferable that the trunk emergency cancellation system operate in different manners depending on the state of the vehicle. That is, when the vehicle is at a stop or the engine is off, the system performs a control of opening the trunk based on the detection. During running of the vehicle, during which it is considered that a driver is in the vehicle, the system notifies the driver of the detection in the manner of alarm or information. It is dangerous to open the trunk upon detection of confinement during running of the vehicle. Furthermore, it is conceivable that a piece of baggage or the like may move in the trunk due to accelerations of the vehicle or the like. Therefore, it is preferable that the system outputs information regarding the detection but does not open the trunk during driving. If the driver suspects or determines that there is a confinement based on the information, the person can stop the vehicle at a safe location, and can check the trunk.

As is apparent from the foregoing description, the invention is able to detect a moving object by using electromagnetic waves. Therefore, it becomes possible to detect confinement of a human, a pet or the like in a trunk, and to perform operations, such as producing an alarm, opening the trunk, etc.

It should be understood that the circuits shown in FIGS. 1, 2, 4–6, 8, 11*b* and 12 can be implemented as portions of a suitable programmed general purpose computer. Alternatively, each of the circuits shown in FIGS. 1, 2, 4–6, 8, 11*b* and 12 can be implemented as physically distinct hardware circuits within an ASIC, or using a FPGA, a PDL a PLA or a PAL, or using discrete logic elements or discrete circuit elements. In general, any device on which resides a finite state machine capable of implementing the figures shown may be used to implement the processor functions of this invention. The particular form each of the circuits shown in FIGS. 1, 2, 4–6, 8, 11*b* and 12 will take is a design choice and will be obvious and predictable to those skilled in the art.

While the invention has been described with reference to specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention.

What is claimed is:

1. An abnormality alarm apparatus, comprising:

at least one electrically conductive member provided in a load-carrying compartment isolated from a passenger compartment of a vehicle;

an oscillator circuit that is connected to the at least one electrically conductive member and that changes an oscillating frequency based on a change in capacitance of a space near the at least one electrically conductive member;

a frequency change detection circuit that detects a moving object in the space near the at least one electrically conductive member based on a change in the oscillating frequency of the oscillator circuit; and an alarm device that produces an alarm based on a result of detection by the frequency change detection circuit, wherein the alarm device produces the alarm when the frequency change detecting circuit detects the moving object during stoppage of the vehicle.

2. An abnormality alarm apparatus according to claim 1, wherein the at least one electrically conductive member is an antenna that transmits a high-frequency signal from the oscillator circuit.

3. An abnormality alarm apparatus according to claim 2, wherein the frequency change detection circuit includes a receiver that is disposed apart from the antenna and that receives an electromagnetic wave transmitted from the antenna, and the frequency change detector detects a change in the frequency of the electromagnetic wave received by the receiver.

4. An abnormality alarm apparatus according to claim 3, wherein the frequency change detection circuit includes a controller that controls an oscillation timing of the oscillator circuit based on the signal received by the receiver.

5. An abnormality alarm apparatus according to claim 4, wherein the controller synchronizes an oscillating process of the oscillator circuit and a receiving process of the receiver.

6. An abnormality alarm apparatus according to claim 3, wherein the electromagnetic wave transmitted from the antenna contains an identification signal.

7. An abnormality alarm apparatus according to claim 6, wherein the identification signal is a signal having a frequency that is higher than a frequency of a signal based on a change regarding the moving object.

8. An abnormality alarm apparatus according to claim 1, wherein the frequency change detection circuit comprises a frequency counter.

9. An abnormality alarm apparatus according to claim 1, wherein the frequency change detection circuit comprises a frequency-voltage converting circuit that converts a frequency into a voltage.

10. A load-carrying compartment opening control apparatus comprising:

at least one electrically conductive member provided in a load-carrying compartment isolated from a passenger compartment of a vehicle;

an oscillator circuit that is connected to the at least one electrically conductive member and that changes an oscillating frequency based on a change in capacitance of a space near the at least one electrically conductive member;

a frequency change detection circuit that detects a moving object in the space near the at least one electrically conductive member based on a change in the oscillating frequency of the oscillator circuit; and an opener that opens an open-close member of the load-carrying compartment when the frequency change detection circuit detects the moving object during a stoppage of the vehicle.

11. A load-carrying compartment opening control apparatus according to claim 10, wherein the at least one electrically conductive member is an antenna that transmits a high-frequency signal from the oscillator circuit.

12. A load-carrying compartment opening control apparatus according to claim 11, wherein the frequency change detection circuit includes a receiver that is disposed apart from the antenna and that receives an electromagnetic wave transmitted from the antenna, and the frequency change detection circuit detects a change in the frequency of the electromagnetic wave received by the receiver.

13. A load-carrying compartment opening control apparatus according to claim 12, wherein the frequency change detection circuit includes a controller that controls an oscillation timing of the oscillator circuit based on the signal received by the receiver.

14. A load-carrying compartment opening control apparatus according to claim 13, wherein the controller synchronizes an oscillating process of the oscillator circuit and a receiving process of the receiver.

15. A load-carrying compartment opening control apparatus according to claim 11, wherein the electromagnetic wave transmitted from the antenna contains an identification signal.

16. A load-carrying compartment opening control apparatus according to claim 15, wherein the identification signal is a signal having a frequency that is higher than a frequency of a signal based on a change regarding the moving object.

17. A load-carrying compartment opening control apparatus according to claim 10, wherein the frequency change detection circuit comprises a frequency counter.

18. A load-carrying compartment opening control apparatus according to claim 10, wherein the frequency change detection circuit comprises a frequency-voltage converting circuit that converts a frequency into a voltage.

19. A load-carrying compartment opening control apparatus according to claim 10, wherein the opener that opens the open-close member of the load-carrying compartment allows an open-close member to open a short distance only when the moving object detection circuit detects the moving object.

* * * * *